US007690302B2

(12) United States Patent
Bernard et al.

(10) Patent No.: US 7,690,302 B2
(45) Date of Patent: Apr. 6, 2010

(54) DEVICE AND METHODS FOR RAISING AND/OR LOWERING A PRINTING FORM

(75) Inventors: Andreas Ewald Heinrich Bernard, Sulzfeld (DE); Lars Keil, Würzburg (DE); Manfred Herrmann Liebler, Erlenbach (DE)

(73) Assignee: Koenig & Bauer Aktiengesellsschaft, Wurzburg (DE)

( * ) Notice: Subject to any disclaimer, the term of this patent is extended or adjusted under 35 U.S.C. 154(b) by 0 days.

(21) Appl. No.: 12/285,211

(22) Filed: Sep. 30, 2008

(65) Prior Publication Data

US 2009/0038494 A1 Feb. 12, 2009

Related U.S. Application Data

(62) Division of application No. 10/564,080, filed as application No. PCT/EP2004/051188 on Jun. 22, 2004, now Pat. No. 7,464,644.

(30) Foreign Application Priority Data

Jul. 11, 2003 (DE) ..... 103 31 595
May 6, 2004 (DE) ..... 10 2004 022 866

(51) Int. Cl.
*B41F 27/12* (2006.01)

(52) U.S. Cl. ..... 101/477; 101/415.1

(58) Field of Classification Search ..... 101/216, 101/378, 383, 415.1, 477
See application file for complete search history.

(56) References Cited

U.S. PATENT DOCUMENTS 5,289,775 A * 3/1994 Spiegel et al. ..... 101/477
5,309,832 A 5/1994 Merkel et al.
5,406,888 A 4/1995 Sugiyama et al.
5,443,006 A * 8/1995 Beisel et al. ..... 101/477
5,540,151 A 7/1996 Ruckmann et al.
5,555,811 A 9/1996 Ruckmann et al.
5,555,812 A 9/1996 Ruckmann et al.
5,595,120 A 1/1997 Metrope
5,701,822 A * 12/1997 Metrope ..... 101/477
5,738,015 A 4/1998 Kusch et al.
6,216,594 B1 * 4/2001 Nakano et al. ..... 101/477
6,601,511 B1 8/2003 Tobe
7,322,290 B2 * 1/2008 Zink ..... 101/477
2005/0223928 A1 * 10/2005 Schneider et al. ..... 101/477

FOREIGN PATENT DOCUMENTS

DE 42 18 602 3/1993
DE 198 38 777 3/2000
DE 100 52 774 5/2002

(Continued)

*Primary Examiner*—Ren Yan
(74) *Attorney, Agent, or Firm*—Jones, Tullar & Cooper, P.C.

(57) ABSTRACT

A printing form is either raised or is lowered by the use of a pressure device which includes a roller. The roller is arranged on a cross-beam in such a way that the roller can selectively be placed on, or taken off the forme cylinder, or a forme that is supported on the forme cylinder, by a device. The pressure device, or the cross-beam which supports the roller can be displaced in a manner such that the distance of the roller from the cylinder can selectively be increased.

3 Claims, 12 Drawing Sheets

FOREIGN PATENT DOCUMENTS

| | | |
|---|---|---|
| EP | 0 679 513 | 3/1995 |
| EP | 0 734 860 | 10/1996 |
| EP | 1 084 839 | 3/2001 |
| JP | 2001-47604 | 2/2001 |
| WO | WO 94/06628 | 9/1993 |

* cited by examiner

DEVICE AND METHODS FOR RAISING AND/OR LOWERING A PRINTING FORM

CROSS-REFERENCE TO RELATED APPLICATIONS

This patent application is a division of U.S. application Ser. No. 10/564,080, filed Mar. 2, 2006, now U.S. Pat. No. 7,464,644 B2, issued Dec. 16, 2008. That application was the U.S. national phase, under 35 USC 371, of PCT/EP2004/051188 filed Jun. 22, 2004; published as WO 2005/007405 A2 on Jan. 27, 2005 and claiming priority to DE 103 31 595.0, filed Jul. 11, 2003 and to DE 10 2004 022 866.3 filed May 6, 2004, the disclosures of which are expressly incorporated herein by reference.

FIELD OF THE INVENTION

The present invention is directed to devices and to methods for drawing-on and/or removing a printing forme. The device includes a storage device which has a dressing receiving chute, a dressing feeding chute and at least one dressing transport device in the storage device.

BACKGROUND OF THE INVENTION

A plate changing device is known from EP 1 084 839 A1, which plate changing device has a pivotable magazine with a feed chute and a receiving chute, a pivotable guidance device, as well as a contact roller, which can be brought in or out of contact. Each chute has a carriage with a hook, by the use of which, the printing forme to be removed is maintained in a one-sided positive contact and is pulled into the chute, or is guided toward the cylinder. The path of the printing forme between the cylinder and the respective magazine chute is determined by pivoting the guidance device.

SUMMARY OF THE INVENTION

It is the object of the present invention to provide methods and devices for drawing-on and/or removing a printing forme.

In accordance with the present invention, the object is attained by the provision of a storage device which has a plate or dressing receiving chute and a plate or dressing feeding chute. At least one transport device is provided for conveying a dressing in the storage device. The transport device is assigned to both of the chutes and includes a holding assembly. The holding assembly is fixed to the frame with respect to the storage device and is assigned to both of the chutes.

A substantial advantage, which can be achieved by use of the present invention, consists in that a rapid and dependable system for drawing-on and/or removing a printing forme is provided with the least possible outlay of funds and space.

By the advantageous embodiment of the present invention as a two-part system, with a semi-automatic device and a magazine, it is possible to select the degree of automation of the device as a function of the requirements of the particular application.

Because of the connection with the plates or dressing, and in particular the frictional, or the positive connection on both sides, the employment of the present invention is freely possible in connection with lower or upper printing groups of identical configuration, without the need of taking gravity into consideration. Here, an effective connection on both sides is to be understood as a connection which is stressed for tension and traction with regard to the plate or dressing conveying direction in the longitudinal direction of the chute.

In comparison with prior art devices which utilize two carriages with two drive mechanisms, the employment of only one movable carriage for use with both the feeding chute, as well as with the receiving chute, lowers the costs, the maintenance outlay and the chance of a breakdown.

In contrast to a positive connection of the holding assembly to the plate or dressing, a frictional connection between the holding assembly and the printing forme makes possible, in a simple manner, the use of printing forms of various formats, without a fresh adjustment and/or additional recesses, hooks, stops or the like being required. The rear end of the magazine, which is embodied in the form of an open quiver, is of particular advantage in view of its utilization with printing formes of different lengths.

A movable flap, which is arranged directly on the magazine and which is usable for selecting the chute and/or for the guidance of the printing forme, reduces the capital outlay required, in comparison with an otherwise additional device to be provided. The flap simultaneously always assures a correct relative position between the magazine chute and the flap.

BRIEF DESCRIPTION OF THE DRAWINGS

Preferred embodiments of the present invention are represented in the drawings and will be described in greater detail in what follows.

Shown are in:

FIG. 1, a schematic side elevation view of a printing press, in

FIG. 2, a schematic top plan representation of webs of different width, in

FIG. 3, a schematic side elevation view of a printing unit, in

DESCRIPTION OF THE PREFERRED EMBODIMENTS

Figure 1:
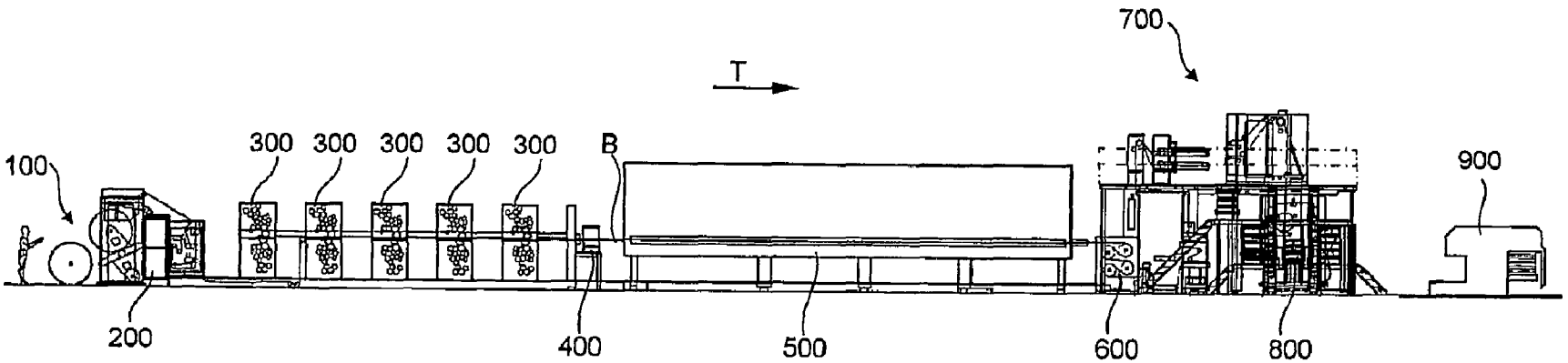

Referring to FIG. 1, a printing press, and in particular a web-fed rotary printing press, intended for use in imprinting one or several webs B, has several units 100, 200, 300, 400, 500, 600, 700, 800, 900 for providing, imprinting and further processing a web. For example, a web B to be imprinted, and in particular a paper web B, is wound off a roll unwinding device 100 before it is supplied, via a web draw-in unit 200, to one or to several printing units 300. In addition to the depicted printing units 300, which are standardized for multi-color printing, such as, for example, four of them for four-color printing, it is possible to provide additional printing units 300, which, in this case, can be utilized, in alternation with one or with several of the remaining printing units, for accomplishing flying printing forme changes, for example.

In an advantageous embodiment, a varnishing unit 400 can be provided in the web path.

Following imprinting and, if required, varnishing, the web B passes through a dryer 500 and is possibly cooled again in a cooling unit 600, if drying is performed thermally. A further conditioning unit such as, for example, a coating device and/or a re-moistening device, which is not specifically represented in FIG. 1, can be provided downstream of the dryer 500 in, or downstream of the cooling unit 600. Following cooling and/or conditioning, the web B can be supplied via a superstructure 700 to a folding apparatus 800. The superstructure 700 has at least one silicon unit, one longitudinal cutter and turning device, as well as a hopper unit, which is also not specifically represented in FIG. 1. The silicon unit can also be arranged upstream of the superstructure 700, for example in the area of the cooling unit 600. Furthermore, the superstructure can have, a perforating unit, a gluing unit, a numbering unit and/or a plow folder, all of which are not represented in FIG. 1. After passage through the superstructure 700, the web B, or partial webs, are conducted into a folding apparatus 800.

In an advantageous embodiment, the printing press also has a separate transverse cutter 900, such as, for example, a so-called piano delivery device 900, in which a web B which, for example, had not been conducted through the folding apparatus 800, is cut into standard sheets and, if desired, is stacked or delivered.

Figure 2:
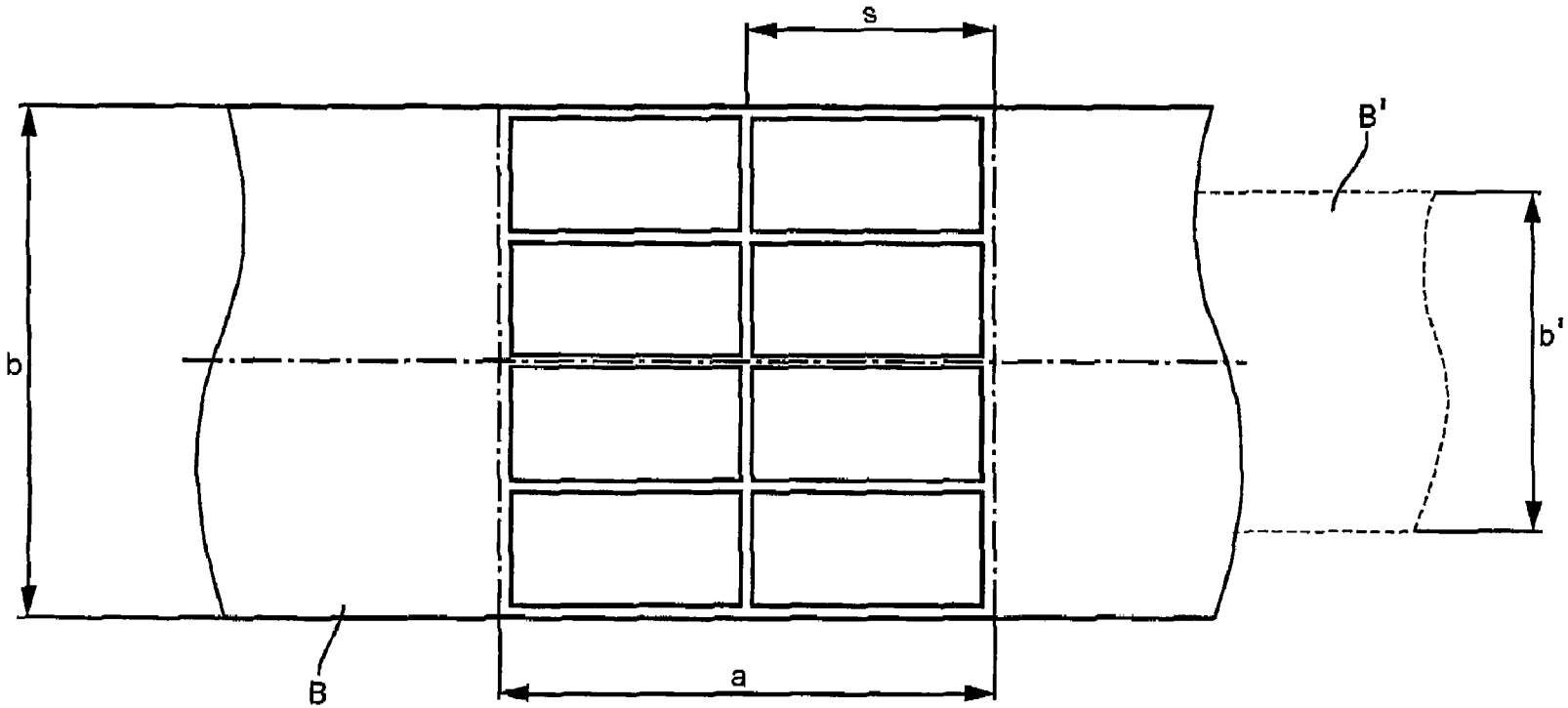

The units 100, 200, 300, 400, 500, 600, 700, 800, 900 of the printing press have an effective width transversely, in respect to a transport direction T of the web B, which effective width permits processing of webs B of a maximum width "b", as seen in FIG. 2, of, for example, up to 1,000 mm. The effective width is understood to be the respective width, or the clear width, of the structural components, such as, for example, the width of the rollers, cylinders, passages, sensor devices, actuating paths, etc. of the units 100, 200, 300, 400, 500, 600, 700, 800, 900, which work together with the web B, either directly or indirectly, so that the web B can be processed, conditioned and conveyed in its full width "b". The functionality, such as material supply, web transportation, sensor devices, further processing devices of the units 100, 200, 300, 400, 500, 600, 700, 800, 900 is configured in such a way that webs B' of only partial width down to a width "b'" of only 400 mm can be processed in the printing press.

The units 100, 200, 300, 400, 500, 600, 700, 800, 900 which define, or process, a section length "a" of web B are configured in such a way that they define, for example, a section "a" of a length of between 540 and 700 mm on the web B. The section length "a" advantageously lies between 540 and 630 mm. In a special embodiment of the invention, the section length "a" lies at 620±10 mm. In a further development of the printing press, the units 100, 200, 300, 400, 500, 600, 700, 800, 900 are configured in such a way that, with a few changes, the printing press can be selectively configured with section lengths of 546 mm, 578 mm, 590 mm or 620 mm. Thus, for example, substantially only an exchange capability of bearing elements for printing group cylinders, a matching of the drive mechanism, as well as matching in the folding apparatus 800 or the transverse cutter 900, all as discussed subsequently, are required for accomplishing the change in order to equip the same printing press for formats which differ from each other. For example, in a standard way, the section length "a" is covered by four vertical printed pages, for example DIN A4, positioned side-by-side in the transverse direction of the web B, and two printed pages, for example of a length s, one behind the other in the longitudinal direction. However, depending on the print image and on the subsequent further processing in the superstructure 700 and in the folding apparatus 800, other numbers of pages per section length "a" are also possible.

Figure 3:
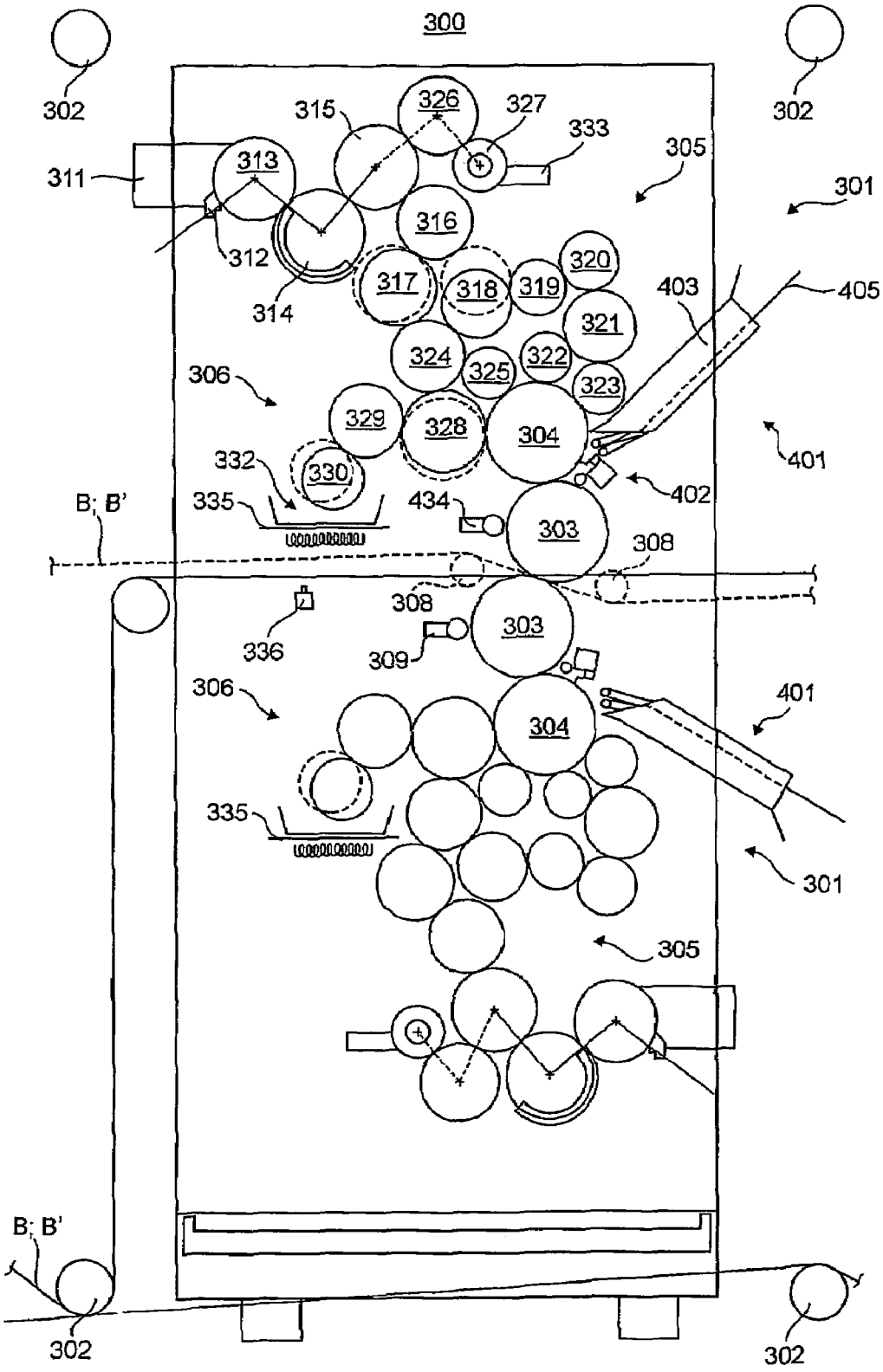

For multi-color imprinting of the web B, B', the printing press has several, such as, for example, at least four, and here in particular five identically equipped printing units 300. The printing units 300 are preferably arranged one next to the other, and a web B, B' passes horizontally through them, as seen in FIG. 1. Each printing unit 300 is preferably configured as a printing unit 300 for offset printing, and in particular is configured as a double printing group 300, or as an I-printing group 300, with two printing groups 301, such as, for example, two offset printing groups 301, as seen in FIG. 3, for accomplishing two-sided printing by the so-called rubber-against-rubber process. Rollers 302 are arranged upstream and downstream at least in the lower area, and optionally in the upper area, of at least one of the printing units 300, by the use of which roller 302 an incoming web B, B' can be conducted around, above or below the printing unit 300, or a web B, B', which has been conducted around an upstream located printing unit 300, can be passed through the printing unit 300, or a web B, B' which has been passed through the printing unit 300 can be conducted around the downstream located printing unit 300.

FIG. 3 schematically shows an arrangement of two printing groups 301 which are working together via the web B, B', each with a pair of printing cylinders 303, 304 embodied as a transfer cylinder 303 and a forme cylinder 304, an inking system 305 and a dampening system 306. In an advantageous embodiment, at the forme cylinder 304, the printing unit 300 has devices 307 for semi- or for fully-automatic plate feeding 401, or for changing of a printing forme 405, as will be described. below in connection with FIG. 4 and the subsequent figures.

In a further embodiment, in particular if the printing press is intended to be suitable for imprinting operations, at least one or several of the printing units 300 have additional guide elements 308 situated closely ahead of, and closely behind the nip point of the printing unit 300. If a web B, B' is to pass through the printing unit 300 without being imprinted and without contact between the web B, B' and the transfer cylinders 303, the web guidance, accomplished with the use of the guide elements 308, shown in dashed lines in FIG. 3, is advantageous. The web B, B' passes through the nip point in such a way that it substantially forms an angle of between 80° and 100°, and preferably of approximately 90°, with a connecting line joining the axes of rotation of the two transfer cylinders 303. Preferably, the guide elements 308 are provided as rods or as rollers, around which air flows. This reduces the danger of previously freshly applied ink rubbing off.

In a further development of the represented printing group 301, a washing device 434 is assigned to each transfer cylinder 303. The elastic surface of the transfer cylinder 303 can be cleaned by use of the washing device 434.

Each of the cylinders 303, 304 has a circumference between 540 and 700 mm. The forme and the transfer cylinder 303, 304 preferably have the same circumference. In an advantageous manner, the circumferences lie between 540 and 630 mm. In a special embodiment, the section length "a" lies at 620±10 mm. In a further development, the printing unit 300 is structured in such a way that, with a few changes, the cylinders 303, 304 can be selectively provided with circumferences of 546 mm, 578 mm, 590 mm or 620 mm. Thus, for example, substantially only an exchange of bearing elements or a changed position of the bores in the lateral frame, and the lug for the cylinders 303, 304, and a matching of the drive mechanism or lever takes place, as discussed subsequently.

In addition to an ink feeding device, such as, for example, an ink fountain 311 with an actuating device 312, for use regulating the ink flow, the inking system 305 has a plurality of rollers 313 to 325. The ink feeding device can also be configured as a doctor blade crosspiece. With the rollers 313 to 325 placed against each other, the ink moves from the ink fountain 311 via the duct roller 313, the film roller 314, and a first inking roller 315, to a first distribution roller 316. Depending on the mode of operation of the inking system 305, as will be discussed below, from there, the ink moves via at least one inking roller 317 to 320 to at least one further distribution cylinder 321, 324, and from there, via at least one application roller 322, 323, 325, to the surface of the forme cylinder 304. In an advantageous embodiment of the inking and dampening systems 305, 306, the second distribution cylinder 324 can also work together with, and at the same time, a roller 328, such as, for example, an application roller 328, of the dampening system 306.

The roller 328 works together with a further roller 329 of the dampening system 306, such as, for example, a distribution roller 329, and in particular with a traversing chromium roller 329. The chromium roller 329 receives the dampening agent from a moistening arrangement, for example from a roller 330, and in particular a dipping roller 330, which dipping roller 300 dips into a dampening agent supply 332, such as, for example, a water fountain. A drip pan 335 is preferably arranged underneath the water fountain for use in catching condensation water forming on the water fountain and which, in an advantageous embodiment, is configured to be heatable, for example by the use of a heating coil.

In a further development, in addition to the rollers 313 to 325, the inking system 305 has at least one further roller 326, by the use of which, ink can be taken from the inking system 305 in the ink path, and in particular can be taken upstream of the first distribution cylinder 316. This takes place wherein an appropriate removal device 333, as seen in FIG. 3 can be placed against this roller 326 itself or, as shown in FIG. 3, against a roller 327 which is working together with roller 326.

In an advantageous further development of the present invention, in its inlet area, or in the area of its inlet nip between the two transfer cylinders 303, the printing unit 300 has a device 336 for affecting a web fan-out effect, i.e. for affecting a change in the transverse extension/width of the web B, B' as the web travels from one print location to the other, which fan-out effect is caused by the printing process and, in particular, is caused by moisture. The device 336 is preferably arranged in the inlet area of a printing unit 300 following the first printing unit 300, i.e. when the web B, B' has been imprinted at least once. Device 336 has at least an actuating member, such as, for example, a support element, by the use of which, the web B, B' can be deflected into a direction perpendicularly in respect to the web level, either by contact with the web B, B', or advantageously without contact.

As depicted in FIG. 3, in an advantageous embodiment of the present invention, the printing group 301 includes a device 401 for use in accomplishing the at least semi-automatic changing of a printing forme 405 on the assigned forme cylinder 304. The printing forme changing device 401 is configured in two parts and has a contact pressure device 402, which is also called a "semi-automatic changer" or a "semi-automatic device" 402, and which is arranged in the area of a nip point between the transfer and forme cylinders 303, 304, and a storage device 403, structurally separated from it, such as, for example a magazine 403, with feeding and receiving devices for the printing formes 405, as is depicted in detail in FIG. 4 and the subsequent drawings.

The printing forme 405 extends, regardless of the possible presence of a device 401 for aiding the printing forme change, substantially across the entire width to be imprinted of the web B, B', and substantially except for a joint or a channel opening over the entire circumference of the forme cylinder 304, and has the corresponding dimensions. The semi-automatic plate changer 402, as well as the associated magazine 403, if it is provided, are dimensioned, in the axial extension, for receiving printing formes 405 of a width of a web B, B', which is to be imprinted as a whole.

Figure 4:
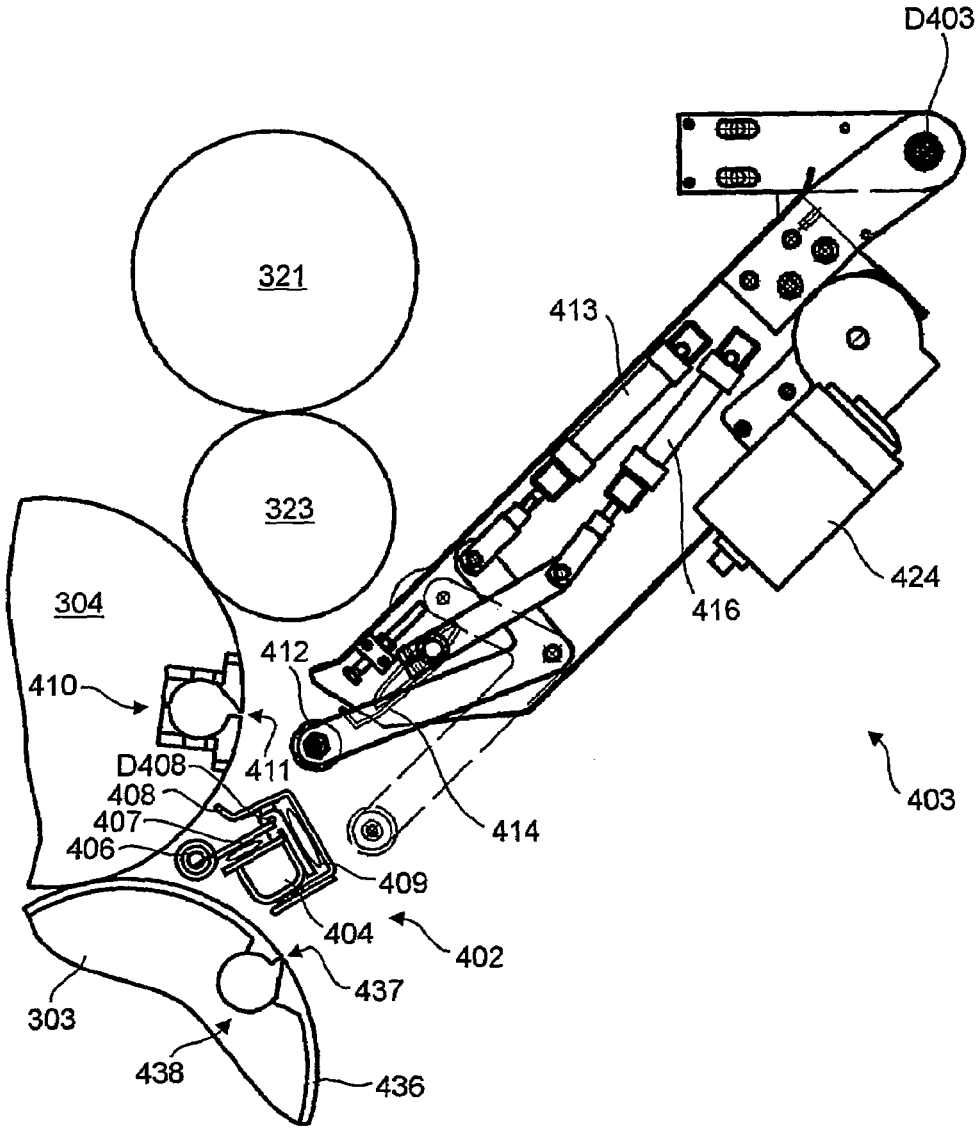
FIG. 4, a side elevation view of a first preferred embodiment of a semi-automatic device with associated magazine, in FIG. 5, a perspective view of a pivotable embodiment of the semi-automatic device of the present invention, in FIG. 6, a longitudinal cross-section through the magazine shown in FIG. 4, in FIGS. 7*a*-7*i* and 7*k*-7*p*, a schematic representations of method steps "a" to "i" and "k" to "p" occurring during the application or removal of plates in accordance with the present invention, in FIG. 8, a simplified side view of a beveled-end printing forme, and in FIG. 9, a schematic representation of a plate end clamping and/or gripping device usable with the present invention.
Figure 5:
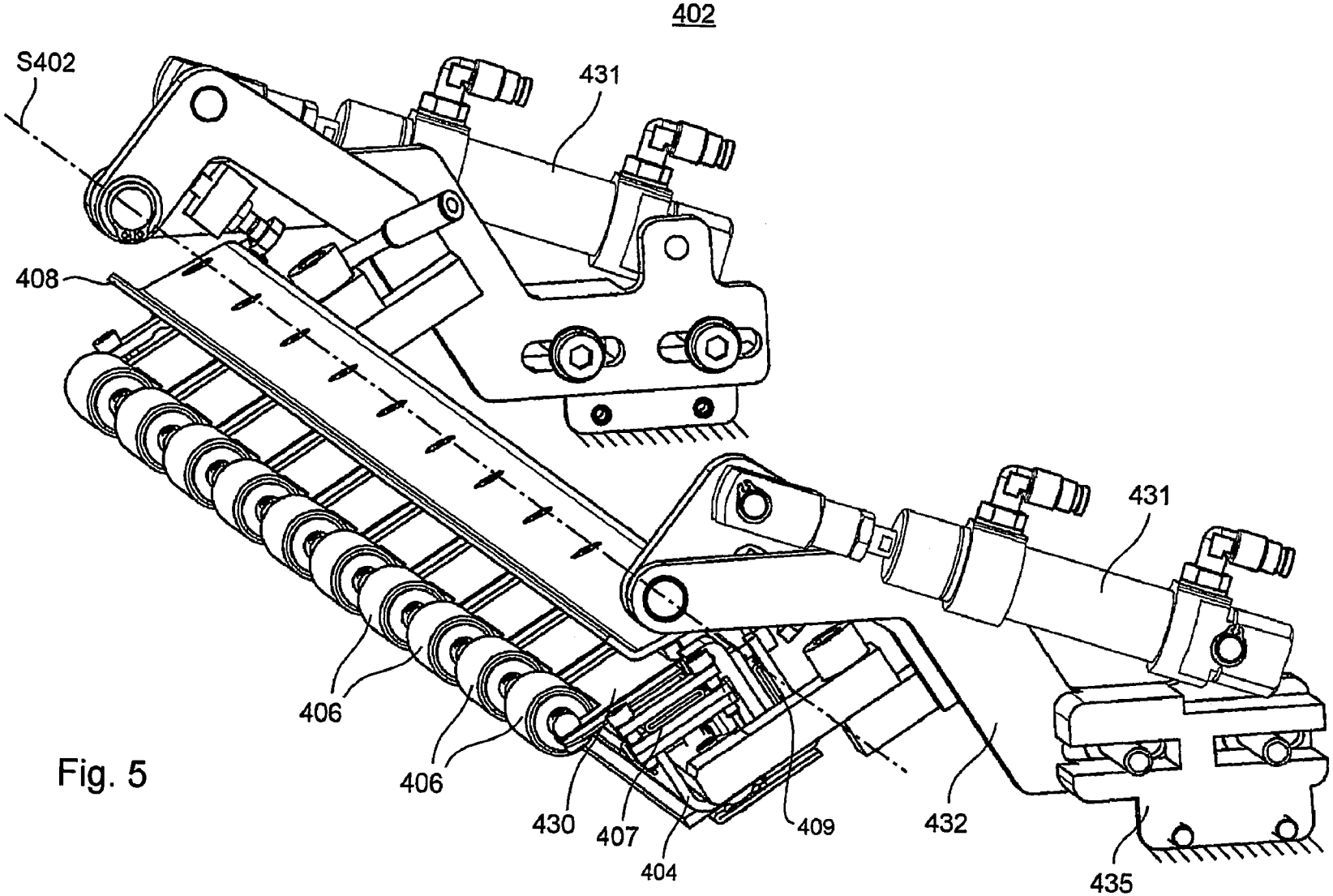

The printing group 301 has at least one semi-automatic plate or dressing changer 402. In a first embodiment, as seen in FIG. 4, a roller 406 for the semi-automatic changer 402 is movably arranged, for example is resiliently supported, on a cross beam 404 that is fixed in place on the printing group frame, which roller 406 can be placed into contact with a shell face of a cylinder 304 by a drive mechanism 407, or actuating device 407, such as, for example a hollow body or hose 407, which can be charged with a pressure medium, to move roller 406 in the direction of the shell face of the cylinder 304, for example against a spring force, or out of contact, for example upon release. In addition, a protective device 408, which can also be brought into and out of contact with the surface of cylinder 304, is also seated on the cross beam 404, and rotatable around a rotation point D408, and can be placed into contact with cylinder 304 by a drive mechanism 409, or an actuating device 409, for example a hollow body or hose 409, which can be charged with a pressure medium, to move the device 408 in the direction of the shell face of the cylinder 304, for example against a spring force, or out of contact, for example upon release. As can be seen in FIG. 5, a plurality, which are shown here as ten such of rollers 406 are seated axially side-by-side, each on respective spring elements 430, in particular spring steel sheets 430. These rollers 406 preferably can be actuated all together or in groups by a common drive mechanism 407.

In a second embodiment of the semi-automatic changer 402, as seen in FIG. 5, the semi-automatic changer 402, or at least the cross beam 404 with the roller 406, is not fixed in place, but is arranged in the printing unit frame so as to be pivotable around a pivot axis S402, which is spaced apart from the axis of rotation of the roller 406, but which extends substantially parallel with respect to the axis of rotation of the forme cylinder 304. A drive mechanism 431, such as, for example, a cylinder 431 which can be charged with a pressure medium, is provided for the pivot movement and is, for example, hinged with one end on the lateral printing unit frame, which is not specifically represented, and with the other end on the semi-automatic changer 402, such as, for example, in engagement with the cross beam 404, or with a lever arm connected therewith eccentrically in respect to the pivot axis S402. The pivotable cross beam 404, or the semi-automatic changer 402, can be pivotably seated directly on the lateral frame or, as is represented in FIG. 5, can be supported by a holder 432 that is appropriately connected with the lateral frame. Advantageously, the holder 432 can be seated on the lateral frame, or on a bearing block 435 which is arranged on the lateral frame, and which is adjustable in a direction that is perpendicularly with relation to the pivot axis S402.

The movement of the roller 406 into and out of contact with the cylinder 304 can take place, in the manner of the first embodiment, by the drive mechanism 407, such as, for example a hollow body 407 which can be charged with a pressure medium, and by a spring force, if desired, in an embodiment with an additional protective device 408.

In an alternative solution, the pivot axis S402 has been selected in such a way that the roller 406, which is fixedly, but is also, if desired, resiliently seated, can be brought into or out of contact by pivoting the cross beam 404 alone. In that case, an additional drive mechanism the roller 406, such as the drive mechanisms 407 can be omitted.

Figure 8:
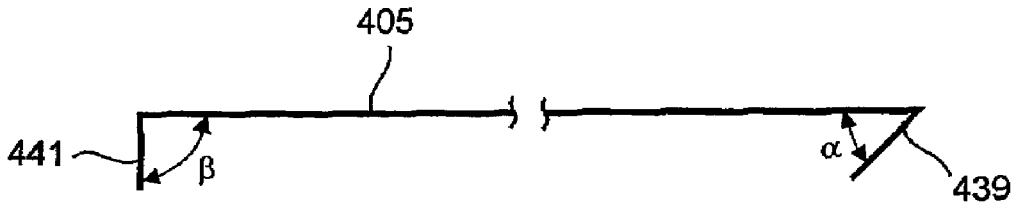
Figure 9:
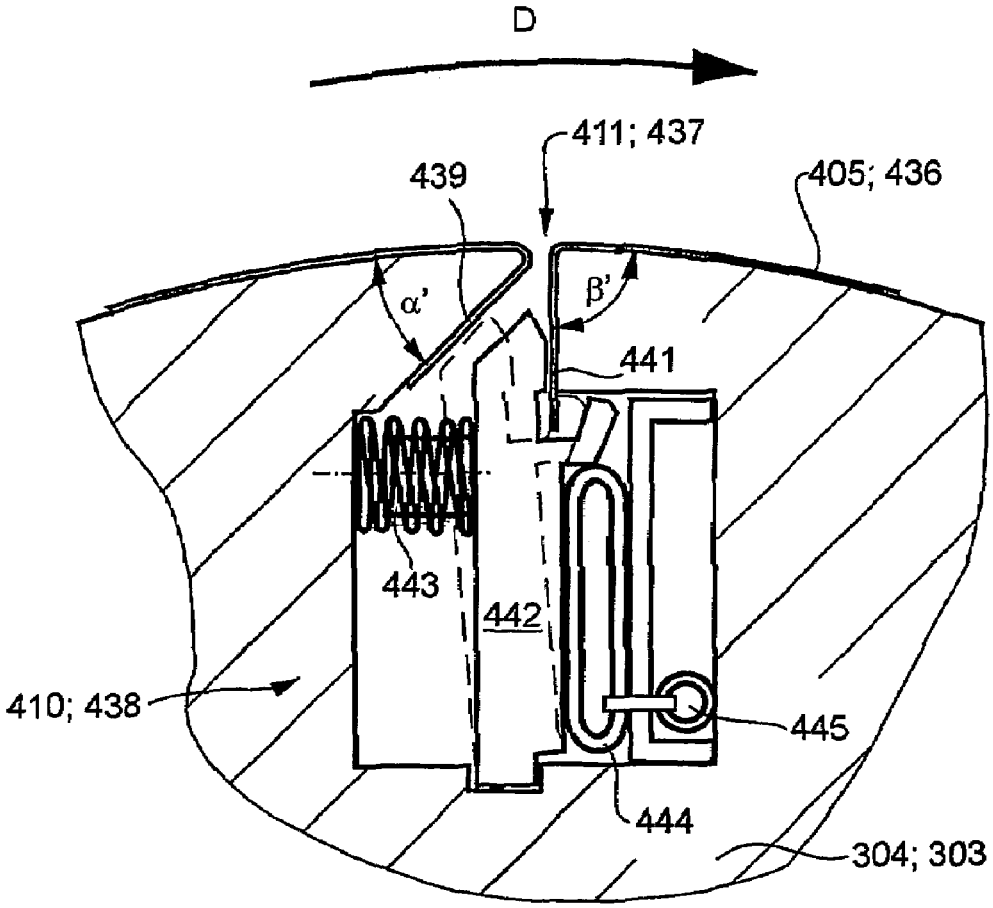

It is possible, in principle, to attach a printing plate 405 in a semi-automatic manner by use of the described semi-automatic changer 402, in either a first or a second embodiment. To this end, in the first embodiment a printing forme 405 to be drawn-on is manually introduced into the space between the roller 406 and the forme cylinder 304 and initially remains there loosely clamped in place. Thereafter, the roller 406 is brought into contact with forme 405, and the cylinder 304 is rotated in a clockwise direction. The leading end of the printing forme 405, which is angled or beveled by 40° to 50°, and in particular by an intermediate angle α of approximately 45°, as seen in FIG. 8, snaps into an opening 411, as seen in FIGS. 4 and 9 of a clamping and/or gripping channel, which channel extends axially in the forme cylinder 304 over at least the usable width. The printing forme 405 is now wound around the cylinder 304 by rotating the latter until the forme trailing edge, which is beveled, in particular by an intermediate angle β of approximately 90°, is also pushed into the channel by the roller 406. Thereafter, a possibly provided, schematically depicted plate end arresting, clamping and/or gripping device 410 is activated. For details regarding the clamping and/or gripping device 410 see FIG. 9. Plate removal takes place accordingly in the reverse sequence, the pushed-out printing forme 405 can be manually removed from the space between the roller 406 and the cylinder 304. In the area of the shell face of the cylinder 304, the opening 411 to the channel preferably has a width of from 1 to 5 mm in the circumferential direction of the cylinder 304, and in particular has a width less than, or equal to 3 mm. The clamping device 410 is advantageously pneumatically operable, and may be, for example, embodied in the form of one or of several pneumatically actuable levers 442, as seen in FIG. 9, which, in the closed state, are prestressed against the plate or forme trailing end 441 which is for example, beveled by approximately 90° and which is extending into the channel. Preferably, a hose 444, as also seen in FIG. 9, which can be charged with a pressure medium, can be used as the actuating device 444. The hose 444 is supplied with a pressure medium through a feed tube or conduit 445. A channel wall, which acting together with the plate or forme leading end 439, forms a nose-shaped intermediate angle α' with the shell face of the cylinder 303 or 304, which substantially angle α' corresponds to the one of the bevel of the plate or forme leading end 439. The same applies to the intermediate angle β' in the area of the opposite wall and to the angle β of approximately 90° of the plate or forme beveled trailing end 441.

In connection with the second embodiment, the attachment or the removal of the plate or forme 405 takes place, in principle, in the same steps, however, at the time during removal in which the leading end 439 is to snap out of the channel of the clamping device 410, the semi-automatic device 402 is, in the meantime, moved from its normal position into the end position, where it is farther removed from the cylinder 304.

However, in a preferred embodiment, the feeding or the removal of the printing forme 405 takes place automatically by the use of the magazine or storage device 403, which magazine or storage device 403 is structurally separate from the semi-automatic changer 402. The second embodiment of the semi-automatic changer 402 is preferably employed in connection with the second embodiment of the magazine 403, which is described below. The first embodiment of the magazine 403 is advantageous for use with the first embodiment of the semi-automatic changer 402. As can be seen in FIG. 4, in this first embodiment, the magazine 403 is seated, pivotable around a pivot point D403 with respect to the lateral frame.

In a first embodiment the magazine 403, a roller 412, which is pivotable around a pivot axis that is extending parallel with the cylinder axis, is seated on the magazine 403, where it can be driven by a drive mechanism 413. In the course of the drawing-on of a fresh printing forme 405, the roller 412 is used for bending the printing forme 405 in such a way that a prestress of the printing forme leading end 439 against the shell face of the cylinder 304 results.

In a second embodiment, the magazine 403, however, does not have the above mentioned roller 412 and the drive mechanism 413, which second embodiment is not explicitly represented. For this reason, the magazine 403, in accordance with the first embodiment, is represented with the roller 412 and with the drive mechanism 413, wherein the subsequent description, aside from the description of the roller 412 and of the drive mechanism 413, is to be applied to the first, as well as the second embodiment of the magazine.

Figure 6:
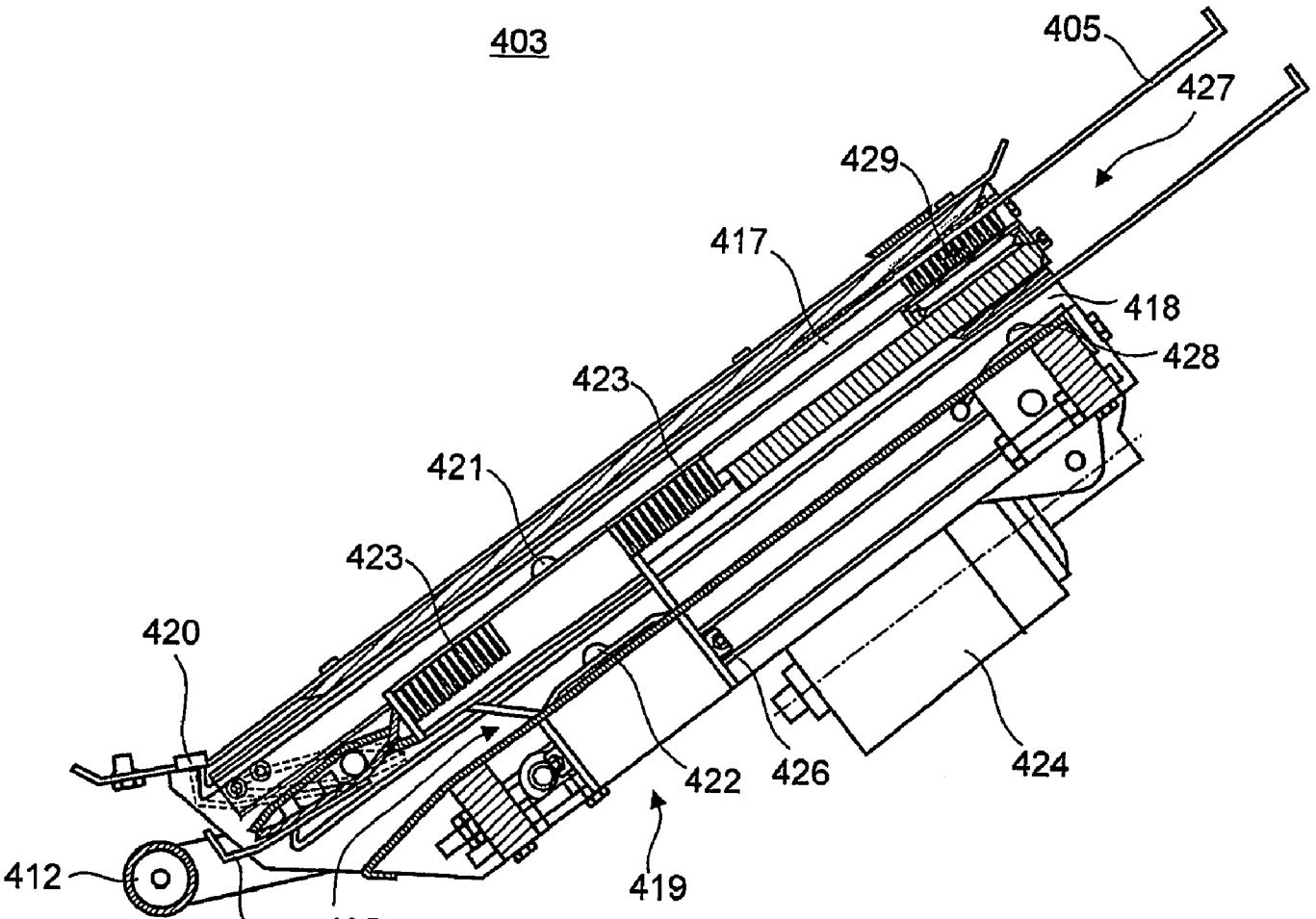

On a side of the magazine 403 which is facing the nip point of the two cylinders 303, 304, a flap 414 is seated, so as to be movable, for example, around a pivot axis that is extending parallel with the cylinder axis. Flap 414 is advantageously driven by a drive mechanism 416, such as, for example, a cylinder which can be charged with a pressure medium. The flap 414 is used for opening or for closing a chute 417, which is more visible in FIG. 6, and which may be, for example, a feeding chute 417 for receipt of printing formes 405 to be freshly attached to cylinder 304. With the feeding chute 417 closed, as depicted in dashed lines in FIG. 6, the path to the nip point is blocked thereby preventing passage of a to be attached printing forme 405 which has been inserted in the feeding chute. A path for receipt and travel of a printing forme 405 to be removed, in the first embodiment past the roller 412, in a chute 418, which may be, for example, a plate or forme receiving chute 418, is free in both positions of the flap 914, as indicated in FIG. 6. For transporting the printing formes 405 in the chutes 417 and 418 of the magazine 403, there is provided a transport assembly 419, for example a carriage 419, which is arranged in the interior of the magazine 403 and which is movable in a longitudinal direction with relation to the chutes 417, 418. Carriage 419 has a first holding device 421, such as, for example, a clamping device 421, on a side working together with the printing forme 405 to be freshly applied, and a second holding device 422, for example a clamping device 422, on the side working together with the printing forme 405 to be removed. Here, the carriage 419 is constructed in one piece or possibly consisting of several connected pieces, and is intended to serve both chutes 417, 418, wherein the carriage 419 encloses at least the one chute 418, forming a passage, or a passage opening 425, for the removed printing formes 405. The carriage 419 preferably extends along both chutes 417, 418, wherein the respective clamping device 421, 422 is provided on one chute side, and the opposite side of the carriage passage is used as a counter-support. For example, the clamping devices 421, 422 are configured as hollow bodies or cylinders, which can be actuated by a pressure medium and which are embodied either to be actively clamping, or to be self-locking, such as, for example by operating against a spring mechanism.

A feeler or sensor 420 is preferably arranged in the area of the flap 414 in such a way that it registers the position of a fresh printing forme 405 in the plate feeding chute 417 when the flap 414 is closed, so that in this way a correct position of the fresh printing forme 405 is assured. Preferably the feeler or sensor 420 is configured as an inductive feeler or sensor 420.

The plate or forme transport assembly or carriage 419, which supports the clamping devices 421, 422 and, if required, brushes 423, is driven by a drive mechanism 424, for example an electric motor 424. This takes place, for example, by the use of a belt drive 426. In principle, the carriage 419 can also be driven by a drive mechanism 424, which is configured as a cylinder, and which can be operated by a pressure medium. A rear end section 427 of carriage 419, which is facing away from the cylinder 304, is preferably configured to be open, at least in the area of the chutes 417 and 418. In this way, printing formes 405 of different formats for printing presses, also of different formats, can be handled with one magazine 403 whose size will accommodate these different formats. One, or several further holding devices 428, 429, such as, for example, clamping devices 428, 429 for each chute 417, 418 can be advantageously provided in the end area 427, which clamping devices cooperate to maintain the respective printing formes 405 in a prepared storage position; i.e. prior to attachment or following removal in the magazine 403. Such a holding device or structure 428, which is fixed in place with respect to the storage device 403, should be provided for at least one of the chutes 417, 418, and in particular should be provided for the receiving chute 418. The clamping devices 428, 429 are fixed on the frame of the magazine 403, while the above mentioned clamping devices 421, 422 are assigned to the movable carriage 419 and are connected with it.

The holding or clamping devices 421, 422, 428, 429 can also be constructed differently than what is represented so that preferably all, but at least the holding means 421, 422, which are assigned to the carriage 419, are configured as connections which are effective on both sides. If desired, this connection can be, in addition to the frictional connection represented, also be a positively connected connection, that is effective on both sides. A connection which is recited as being effective on both sides should be understood to be a connection which can be stressed for tension and for traction with regard to the conveying direction in the longitudinal direction of the chute.

Figure 7A:
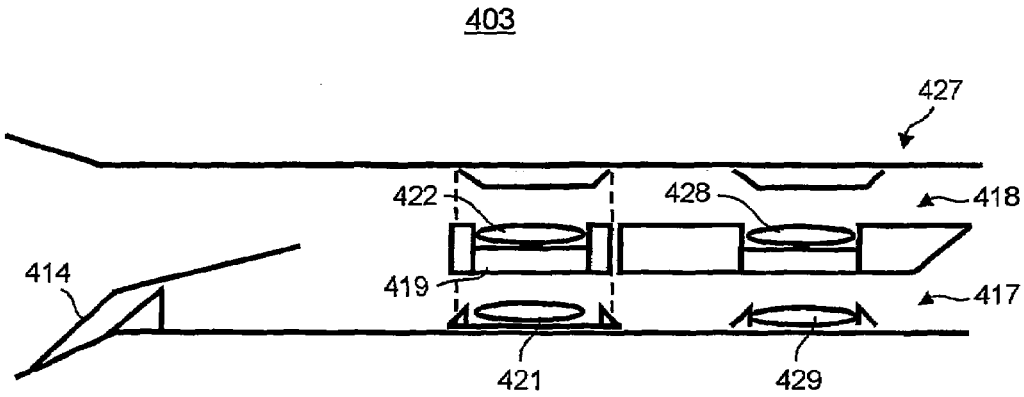
Figure 7B:
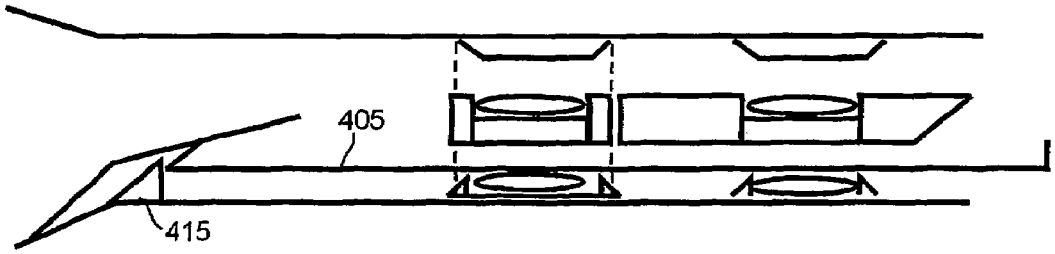
Figure 7C:
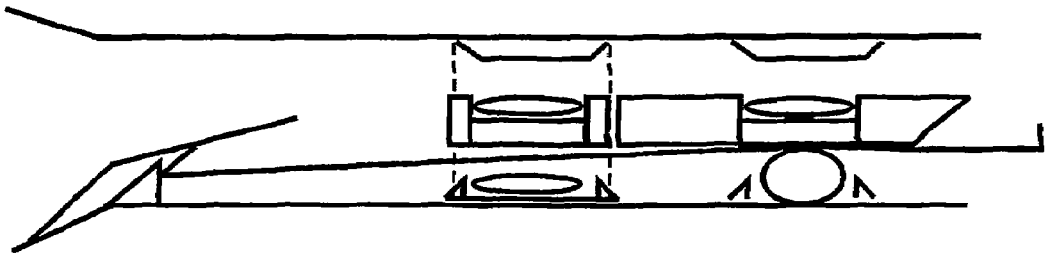
Figure 7D:
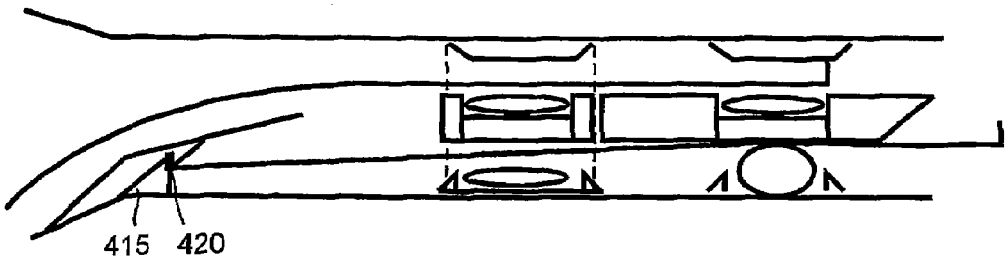
Figure 7E:
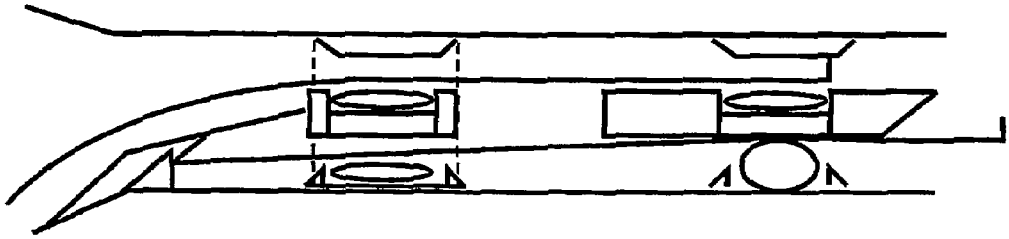
Figure 7F:
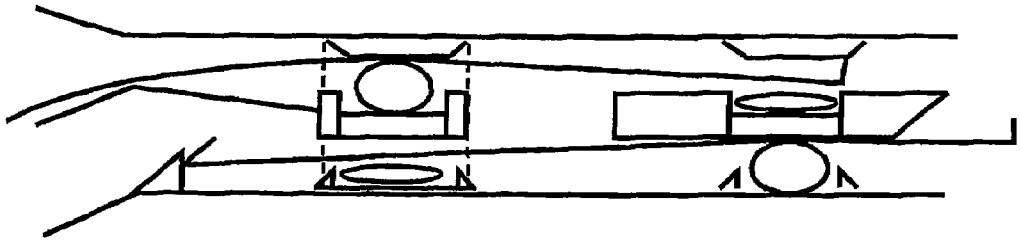
Figure 7G:
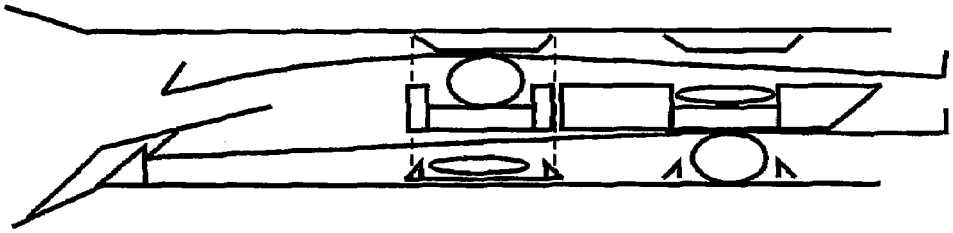
Figure 7H:
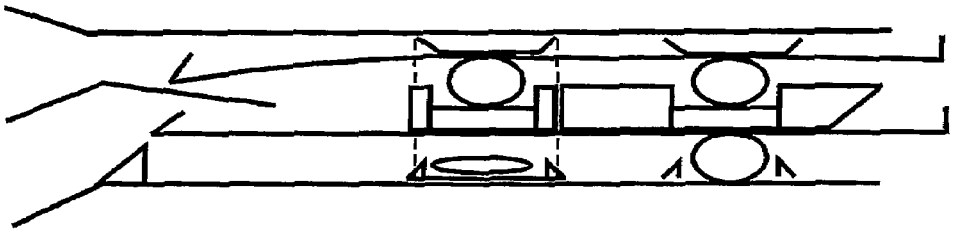
Figure 7I:
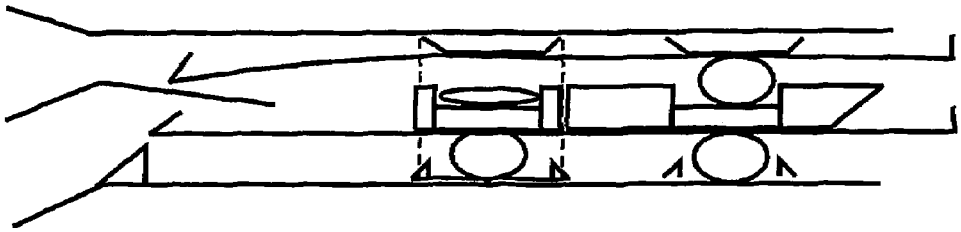
Figure 7K:
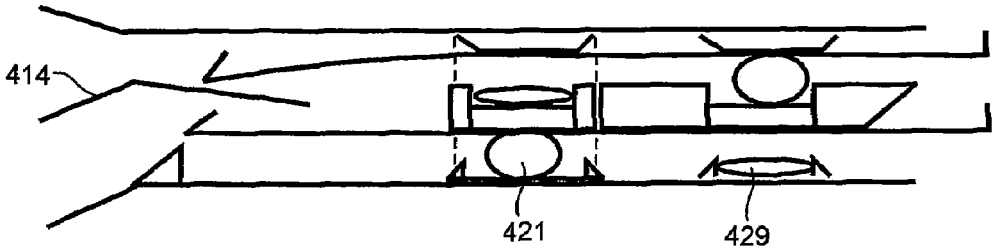
Figure 7L:
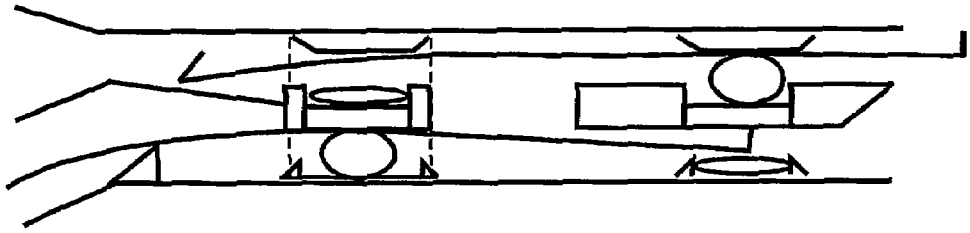
Figure 7M:
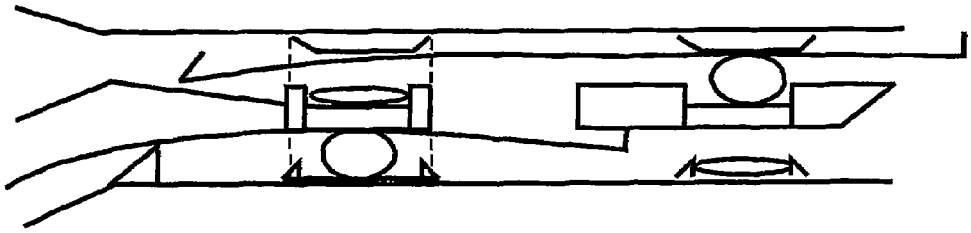
Figure 7N:
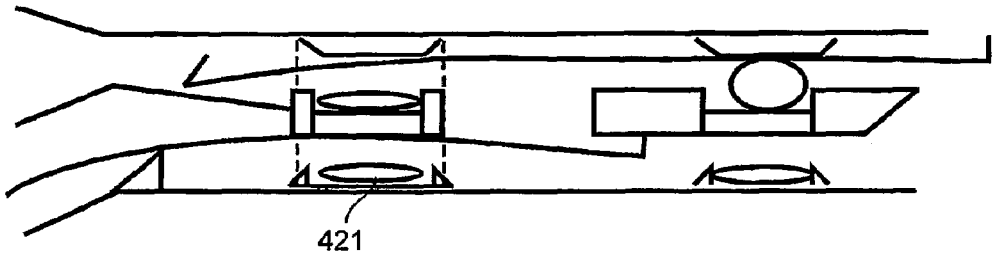
Figure 7O:
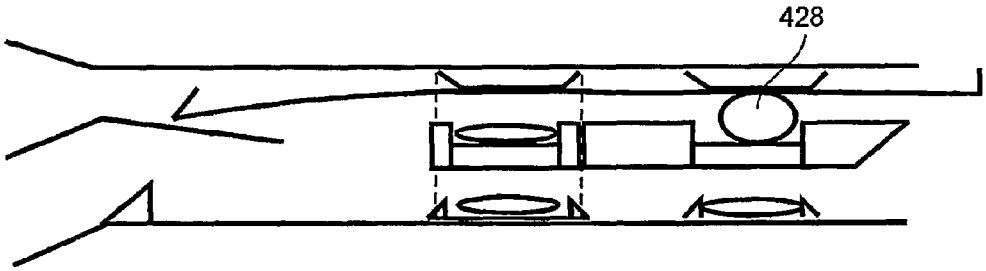
Figure 7P:
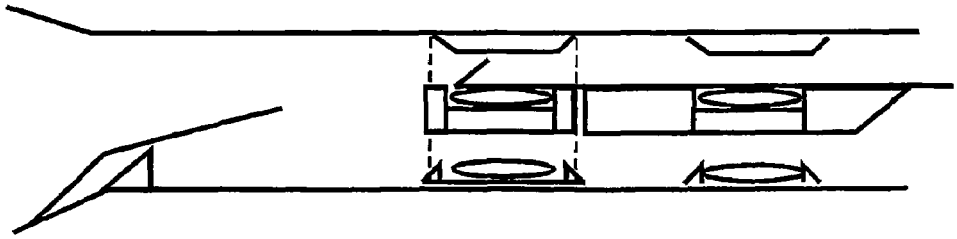

The actions, or the method steps in the magazine 403 during removal or installation are schematically represented in the accompanying FIGS. 7*a* to 7*p* of the drawings. For reasons of clarity, the reference numerals will be used only in the first figures. In the representations in FIG. 7, the chutes 417 and 418 with the associated clamping devices 421, 422, 428, 429 are reversed by way of example with respect to the representation in FIG. 6. Although it is possible, in principle, to configure the magazine 403 with the feeding chute 417 to be always at the top and with the receiving chute 418 always at the bottom, or vice versa, it is practical for the feeding chute 417 to be arranged on the side of the magazine 403 closer to the web B, B', so that with an upper printing group 301 the feeding chute 417 is arranged to lie on the bottom, and with a lower printing group 301 the feeding chute 471 is arranged to lie on the top.

FIG. 7*a* shows the magazine 403 in the initial position, i.e. one in which there is no printing forme 405 in either one of the chutes 417, 418, and wherein the clamping devices 421, 422, 428, 429 are disengaged, so that they release the respective chutes 417, 418 and are, for example, in a position of rest. Furthermore, the flap 414 is in a position in which the feeding chute 417 is closed and the receiving chute 418 is open. The carriage 419 is in a rear position, which is its position of rest. Now, a printing forme 405 is introduced into the feeding chute 417, as seen in FIG. 7*b*, until it comes to rest, for example, against a stop 415, and is subsequently secured by the clamping device 429 which is fixed on the frame, as shown in FIG. 7*c*. Forme securement can take place either automatically or under the condition that a feeler or a sensor 420 recognizing the leading edge, for example in the area of the stop 415, but only represented in FIG. 7*d* registers the correctly positioned fresh printing plate 405. Now, the magazine 403 is ready for a possibly subsequent placement of forme or plate 405 on an "empty" cylinder 304, which would be continued with the clamping of the fresh printing plate 405 in accordance with FIG. 7*i*, but without an accompanying releasing of an old printing plate 405 from the carriage 419.

However, if a plate change is to be performed, or only if an old printing plate 405 is to be removed from the cylinder 304, the steps to be discussed in accordance with FIG. 7*d*, inclusive of FIG. 7*h*, are required, possibly with the step for releasing the old printing plate 405 from the carriage 419, as depicted in FIG. 7*i*.

It is not shown, in FIG. 7*d*, that for plate removal, initially the roller 406 represented in FIGS. 4 and 5 is placed by the drive mechanism 407 against the printing plate 405 which is still located on the cylinder 304. Subsequently, the possibly provided arresting, clamping or gripping device 410 for the trailing end of the printing plate 405 is released, so that, in the course of rotating the cylinder 304 in the direction opposite to the production direction, the end of the plate 405 can escape from the channel. The printing plate 405 is now released by the rotation of the cylinder 304, and is guided by the roller 406, or, at this point, is still pressed against the shell face by it, and is released, step by step, from the cylinder 304 because of the plate or forme inherent tension, and is pushed into the receiving chute 418 by the rotation of the cylinder 304 (FIG. 7*d*). During this process, the two clamping devices 422, 428, which are assigned to the receiving chute 418, are inactive.

The carriage 419 is already either in a position close to the cylinder or, as represented in FIG. 7*e* in comparison with FIG. 7*d*, can be moved there. In a phase in which the printing forme 405 has been unwound to a large degree, and the leading end 439 of forme 405 is almost or is already underneath the roller 406, the roller 406 is moved away from the cylinder 304 so that, following the release of the clamping device 410 and the further rotation of the cylinder 304, that the leading end 439 of the forme 405 can spring out of the channel.

To simplify the release of the leading end 439 of the printing plate 405 from the channel of the arresting, clamping or gripping device 410, as seen in FIG. 9, in an advantageous method step, the printing plate 405 is bent in a suitable manner in an end phase of its unwinding in a first variation by pivoting of the roller 412 in accordance with FIG. 4. In this way, the leading end 439 of the plate 405 is provided with a torque because of the bending of the printing plate 405 in order to be able to escape, in a simpler way, from the channel in the course of the further rotation of the cylinder 304. As represented, by way of example in FIG. 7*f*, bending can also take place by resetting the flap 414, in which case a roller 412 and its drive mechanism 413, which otherwise, to be especially provided, can be omitted.

In another variation of the invention, the semi-automatic device 404, which, in accordance with FIG. 5, is pivotable, is, in this state, moved into a position so that the roller 406, whose drive mechanism 407 has been deactivated, and which had already been disengaged shortly before this, is even further removed from the cylinder 304. In this way, the leading end 439 of the forme or plate 405 is provided with sufficient space for escaping more easily from the channel, in the course of further rotation of the cylinder 304.

If the leading end 439 of the printing plate 405 has also been removed from the channel of the arresting device, the printing plate 405 can no longer be conveyed by continued rotation of the cylinder 304. As represented in FIG. 7*f*, the printing plate 405 to be removed is now clamped by the clamping device 422 of the carriage 419, which carriage 419 is in the forward position, and the printing plate 405 is pulled completely into the receiving chute 418 of the magazine 403 by moving the carriage 419 into a rear or retracted position, as seen in FIG. 7*g*.

After releasing the front edge 439 of the plate 405 from the channel of the arresting device, the roller 412 of the one variation of the plate changer, or the pivotable semi-automatic device 402 of the other variation of the plate changer, can be returned into its normal position.

By the subsequent clamping of the printing plate 405, by use of the clamping device 428 fixed on the frame, the plate 405 is secured in a parked position until its removal by either the operators of the press or by use of a device provided for this, as seen in FIG. 7*h*. It is thereafter possible, as can be seen in FIG. 7*i*, to release the clamping device 422, which is assigned to the carriage 419. With this release, the step of releasing an "old" printing plate is finished, except for removal of the "old" printing plate from the chute 418. To remove the old printing plate 405, at this, or at a later time, it is merely necessary to release the clamping device 428 and to remove the printing plate 405 through the preferably open rear end 427 of the magazine 403.

In the case of attaching plates during a plate change, or in the use of a fresh printing plate 405 at the start of production, the steps described below are intended to follow the previously-mentioned steps in FIGS. 7*a* to 7*c*. The fresh printing plate 405 is clamped to the carriage 419, which carriage 419 is in its rear or retracted position, as shown in FIG. 7*i*, second part by use of the clamping device 421 that is assigned to the carriage 419 in the area of the feeding chute 417. Clamping is now released by the clamping device 429, which is fixed on the frame, as shown in FIG. 7*k*. If the flap 414 is still in the position in which it closes the feeding chute 417, flap 414 is opened by actuating the drive mechanism 416. By moving the carriage 419 into a forward position, or to the left in FIG. 7L, the fresh printing plate 405 is moved out of the chute 417 to the cylinder 304. By activating the drive mechanism 407, the roller 406 is placed against the cylinder 304 before the printing plate 405 reaches the shell face of cylinder 304. The roller 406 is used as a stop for the leading end 439 of the printing forme 405. In the course of this, the roller 406 now rotates, together with the cylinder 304, which is now turning in the production direction by friction, in such a way that the leading end 439 of plate 405 experiences a force in the direction of the shell face of the cylinder because of friction at the roller surface. When, because of the continued rotation of the cylinder 304, the channel of the clamping and/or gripping device 410 passes underneath the leading end 439 of the printing plate 405 touching the roller 406, the plate leading end 439 is pushed into the channel, as aided by the roller 406 and its rotating movement. Preferably, the plate 405 is not released by the clamping device 421 of the magazine 403 immediately after its leading end snaps in, but is, as shown in FIG. 7*m*, still held by the clamping device 421 until it has been partially drawn onto the shell surface of the cylinder 304.

While the printing plate 405 is being further drawn on to cylinder 304 by the rotation of the cylinder 304, the clamping of the plate 405 by the clamping device 421 of the carriage 419 is released, as seen in FIG. 7*n*. The roller 406 of the plate changer 402 remains placed against the printing plate 405 during the entire process of drawing it on, and finally pushes the printing plate trailing end 441 into the channel. Following arresting of the plate end in the channel, the roller 406 is brought out of contact, i.e. the pressure medium 407 is deactivated. After the release of the clamping device 421 of the magazine 403, the carriage 419 is preferably moved back into its position of rest, i.e. its rear position, as shown in FIG. 7*o*. As previously mentioned, in case of a plate change, it is now possible to remove the old printing plate 405, after the clamping device 428 has been released, as seen in FIG. 7*p*. Now, both chutes 417, 418 are empty, and the carriage 419 is in its initial position. To this end, the flap 414 is now placed into the position, if required, in which the receiving chute 418 is opened for receipt of a printing plate 405 to be installed.

On its circumference, the transfer cylinder 303 has at least one dressing 436, as depicted in FIG. 4, which dressing 436 is maintained in at least one channel which is extending axially on the shell face of cylinder 303. The transfer cylinder 303 preferably has only one dressing 436 extending over the effective length, or substantially over the entire width of the web B, B' to be imprinted, and substantially extending, except for a joint, or a channel opening over the entire circumference of the transfer cylinder 303. Preferably, the dressing 436 is constructed as a so-called metal printing blanket 436, which has an elastic layer of, for example, rubber on a substantially dimensionally stable support layer, such as, for example, a thin metal plate. The ends of this dressing 436 are passed through an opening 437 in the transfer cylinder's shell face into the channel and are maintained there in a frictionally connected way or in a positively connected way. In the case of a metal printing blanket 436, the ends are bent/beveled off, for example in the area of the blanket's leading end by approximately 45°, and in the area of the blanket's trailing end by approximately 135°, or by an intermediate angle of 45°. These ends extend through the opening 437 of a channel that is extending axially over the entire useful width of the transfer cylinder 303, and which channel also has, for example, an arresting device 438, such as a clamping and/or gripping device 438, and in particular a device 438 corresponding substantially to the clamping device 410, as represented in FIG. 9 in connection with the forme cylinder 304. However, in the representation of FIGS. 8 and 9, the printing forme 410 corresponds, for example, to the dimensionally stable support layer of the dressing 436 and is embodied as a metal printing blanket 436 wherein, however, an elastic layer on the effective outer surface is not represented in FIG. 9. In the area of the shell face, the opening 437 to the channel preferably has a width, in the circumferential direction of the cylinder 304, of preferably 1 to 5 mm, and in particular to less than or equal to 3 mm. The clamping device 438 is preferably pneumatically operable, and may be embodied, for example, in the form of one or several pneumatically actuable levers 442 which, in their closed position are prestressed by a spring force which is applied against the trailing end that is extending into the channel. A hose 444, which can be charged with a pressure medium, can preferably be employed as the actuating member 444.

The transfer cylinder 303 preferably has a single dressing 436, which is embodied as a printing blanket 436 and which, regardless of the possible presence of a washing device 434 or the special construction of a clamping device 438, substantially extends over the entire width of the web B, B' to be imprinted, and substantially, except for a joint or a channel opening over the entire circumference of the transfer cylinder 303, and which has the corresponding dimensions.

While preferred embodiments of a device and methods for drawing in or removing a printing forme from a forme cylinder of a printing unit in accordance with the present invention have been set forth fully and completely hereinabove, it will be apparent to one of skill in the art that various changes in, for example the specific web being printed, the drive assemblies for the various cylinders, and the like could be made without departing from the true spirit and scope of the present invention which is accordingly to be limited only by the appended claims.

What is claimed is:

1. A method for selectively drawing a dressing onto a cylinder and removing a dressing from a cylinder including:

providing a dressing storage assembly;

providing a dressing storage chute in said dressing storage assembly;

using said dressing storage chute for receiving a dressing to be removed from the cylinder;

providing a dressing feeding chute in said dressing storage assembly;

using said dressing feeding chute for feeding a dressing to be positioned on the cylinder;

providing a transport means serving to transport dressings in both said dressing feeding chute and said dressing storage chute in said dressing storage assembly;

providing a first, dressing holding means on said transport means and assigned to said dressing storage chute;

providing a second, dressing holding means on said transport means and assigned to said dressing feeding chute;

activating said first, dressing holding means for clamping a dressing during use of said transport means for transporting a dressing to be removed from the cylinder and received in said dressing storage chute and deactivating said second dressing holding means;

activating said second, dressing holding means for clamping a dressing during use of said transport means for transporting a dressing to be fed to said cylinder from said dressing feeding chute and deactivating said first dressing holding means;

providing a contact pressure device on said dressing storage assembly and intermediate said dressing storage chute, said dressing feeding chute and the cylinder;

supporting said contact pressure device for movement into and out of contact with the dressing on the cylinder;

contacting the dressing to be removed from the cylinder with said contact pressure device during removal of the dressing from the cylinder by pivoting said contact pressure device;

bending the dressing during said removal of the dressing from the cylinder in response to said contacting of the dressing with said contact pressure device;

causing a torque on the dressing during said removal of the dressing from the cylinder in response to said bending of the dressing; and using said torque for removing an end of the dressing from the cylinder.

2. The method of claim 1 further including providing a drive motor for said contact pressure device and using said drive motor for moving said contact pressure device.

3. The method of claim 1 further including providing said contact pressure device having at least one roller.

* * * * *